US006691341B2

(12) United States Patent
Loch

(10) Patent No.: US 6,691,341 B2
(45) Date of Patent: Feb. 17, 2004

(54) SINK FORM AND PROCESS

(76) Inventor: Jay M. Loch, 2017 Bellevue Dr., Glendale, CA (US) 91201

( * ) Notice: Subject to any disclaimer, the term of this patent is extended or adjusted under 35 U.S.C. 154(b) by 0 days.

(21) Appl. No.: 10/066,275

(22) Filed: Feb. 2, 2002

(65) Prior Publication Data

US 2002/0108172 A1 Aug. 15, 2002

Related U.S. Application Data

(60) Provisional application No. 60/267,049, filed on Feb. 7, 2001.

(51) Int. Cl.[7] ..... A47K 1/00
(52) U.S. Cl. ..... 4/632; 249/13
(58) Field of Search ..... 4/631, 632; 52/389; 249/13; 312/140.3

(56) References Cited

U.S. PATENT DOCUMENTS

| | | | | |
|---|---|---|---|---|
| 1,827,053 A | * 10/1931 | Veneman | 4/631 X |
| 2,600,599 A | * 6/1952 | Wycoff | 4/632 X |
| 4,175,292 A | 11/1979 | Morrison | 4/660 |
| 4,771,488 A | 9/1988 | Markham | 4/631 |
| 5,016,297 A | 5/1991 | Sauter et al. | 4/619 |
| 5,754,991 A | 5/1998 | Drozdowich et al. | 4/631 |
| 5,860,172 A | 1/1999 | Pfeiffer | 4/631 |
| 6,108,832 A | 8/2000 | McIntire | 4/646 |

OTHER PUBLICATIONS

American Builder, "How–To–Do–It Pointers", Jul. 1948, p. 120.*

* cited by examiner

*Primary Examiner*—Robert M. Fetsuga
(74) *Attorney, Agent, or Firm*—John E. Wagner; Robert C. Smith

(57) ABSTRACT

A sink form for use in installing a sink having laterally extending flanges in a countertop is preferably formed of a plastic material, such as nylon or polypropylene resin. It is preferably made to the exact shape of the cut-out opening for the sink, although for round or oval sinks, the form may consist of a flexible strip of the proper cross-section cut to length as required to match the opening. The sink form has a cross section consisting of a downwardly extending portion which is secured to the edges of the opening, a laterally extending flange portion, and, at the outer edge of the flange portion, an upstanding vertical portion terminating in an outwardly curved part. The downwardly extending portion is secured to the edge of the cut-out opening with the laterally extending flange portion spaced away from the countertop to allow for a layer of concrete float material between the flange portion and the countertop. The outwardly curved part has a curvature matching the inside curvature of the quarter round tiles which are installed over the sink flanges. The sink form may include a continuous bottom enclosing the form.

20 Claims, 3 Drawing Sheets

34
30
10
13
28
22
20

FIG. 2
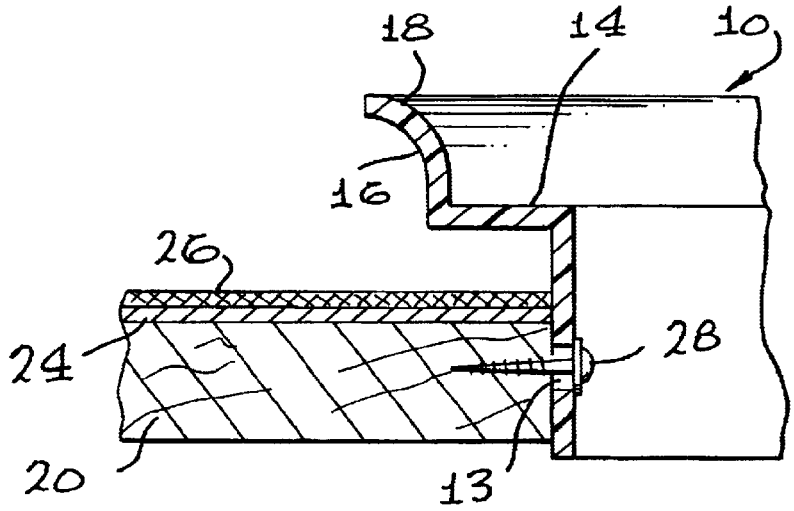
FIG. 3
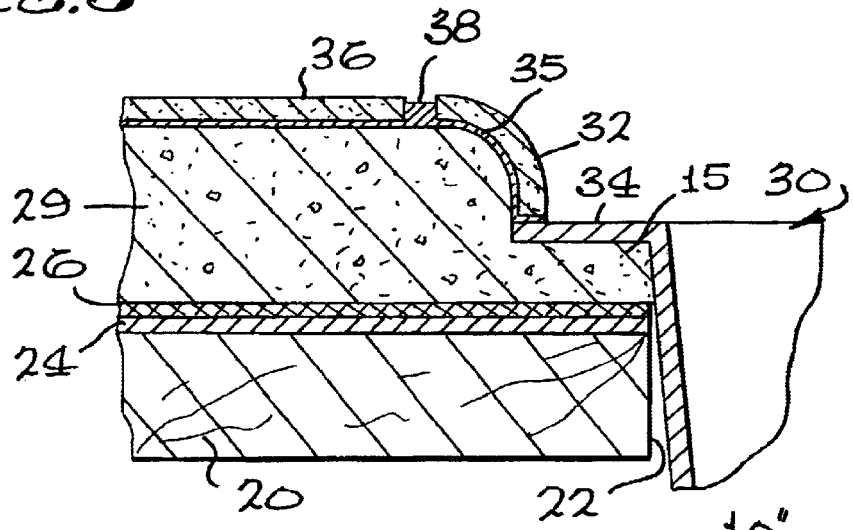
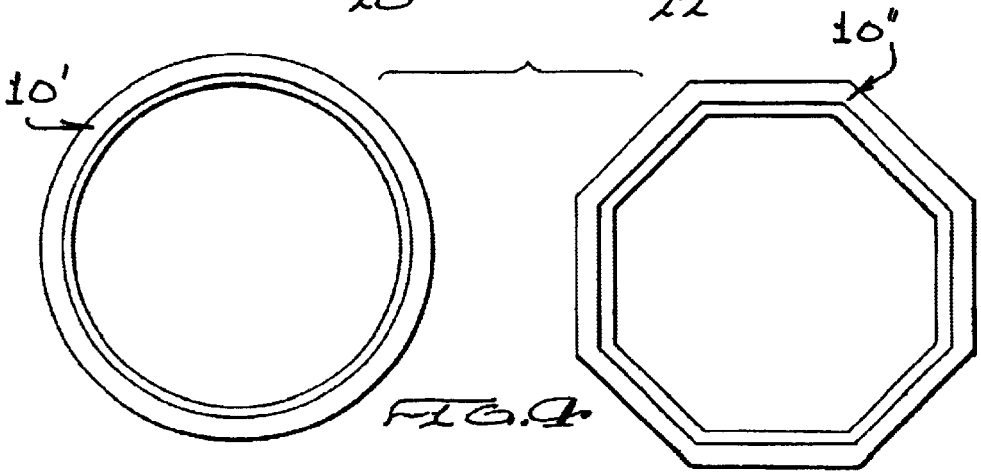
FIG. 4

SINK FORM INSTALLATION

SINK FORM AND PROCESS

REFERENCE TO RELATED APPLICATION

This non-provisional patent application claims benefit of U.S. provisional patent application Ser. No. 60/267,049 filed Feb. 7, 2001, and hereby claims the benefit of the embodiments therein and of the filing date thereof.

BACKGROUND OF THE INVENTION

The present invention relates to a device and method for use in installing sinks in ceramic tile countertops. Because of the weight of the tile and the concrete "float" layer normally used to stabilize the tile layer, the underlying countertop is typically of strong material, such as ¾-inch plywood, suitably supported, from which an opening is cut to receive the sink.

On top of the plywood countertop is placed a moisture barrier layer and a layer of metal lath. The concrete layer is then run in or "floated" over these layers. There is a difficulty in providing just the right thickness of concrete ledge to support the edge of the sink at all points in its periphery and also to provide the exact deeper level of concrete, which will enable a tile quarter round to be installed over the edge of the sink so that it will be even and flush with the level of the tile layer. A considerable amount of time is frequently required to provide the desired levels of the concrete layer to which the tiles are attached. There is, therefore, a need for a means to speed up and simplify installing the concrete float layer.

Problems relating to the installation of sinks in countertops have been the subject of a number of prior art patents. If the flange of the sink is supported on the countertop, sealing between the sink and the countertop may be difficult to achieve or maintain. Cleaning over the flange of the countertop often causes water and cleaning solution to run back over the countertop. Wiping the countertop next to the flange may force water and dirt under the flange. For this and other reasons, there is a preference in current practice to install the sink such that countertop material, such as ceramic tile, extends over the flange.

U.S. Pat. No. 5,754,991 teaches a countertop mounting unit and method of installing such unit in which, after the countertop deck sheet is cut out to fit the sink, a non-porous seal ring, which may be made of any of several polyester resins, is formed to fit inside the cut out and to abut the edge of the cut out. The cross section of the seal ring may be molded or extruded to have the desired profile to accommodate the sink flange. Additional seals, such as O-rings, are applied between the seal ring and the sink flange. Where ceramic or other tiles are installed, the seal ring is formed to accommodate the thickness of the tile and cement used to secure the tile to the seal ring and the countertop. This technique involves forming a seal ring having a special cross section depending upon the tile or laminated surface used.

U.S. Pat. No. 5,016,297 is primarily concerned with mounting a metal sink in a countertop and uses a support rim of a plastic material which preferably extends above the sink flange. A coupler of a glass-filled polyester resin is injected into position in a rubber mold which remains in position until the resin hardens. This procedure is essentially unrelated to applicant's device and method of installing sinks in ceramic tile countertops wherein the sink form is removed before the sink is placed in position.

U.S. Pat. No. 5,860,172 also shows a sink construction and method using a metal sink which is installed in a vertical wall of polymer based solid surface sheet material, such as a thermoplastic sheet material available from DuPont under the name CORIAN®. In this construction, the vertical wall actually becomes part of the sink. The construction is primarily concerned with effecting a seal between a laterally extending edge of the sink and the vertical wall. It is not concerned with installing a sink in a countertop having a surface of ceramic tile.

U.S. Pat. No. 6,108,832 teaches a special metal collar having a laterally extending circumferential rim which fits around a sink bowl. After a rough cut out is made in the countertop, the metal collar is secured to the underside of the countertop. It can then be used as a template to make a precise cut out of the exact shape of the sink. The metal collar is then removed and the sink installed which will then be flush or even with the top of the countertop, including a layer of laminated surface. This patent is not concerned with installing a sink in a ceramic tile countertop.

Other patents showing various method and constructions for installing sinks in countertops are disclosed in U.S. Pat. Nos. 4,175,292 and 4,771,488.

BRIEF SUMMARY OF THE INVENTION

Applicant has devised a form, preferably of a plastic material, such as nylon or polypropylene resin, which extends around the perimeter of the sink cut out, and which includes a cross section having an outwardly extending flange of width approximately the width or slightly less than the width of the exterior flange of the sink to be installed. It also includes an upstanding outwardly extending curved portion defining a depth of concrete float material required above the sink flange and a curved surface to support the curved tile quarter rounds, such that their top surfaces are even with the countertop tile to be laid and a downwardly extending portion which closely fits the edge of the cut out. This downwardly extending portion preferably includes a number of vertically oriented slots for receiving screws used to secure the form to the cut out edge of the countertop material.

To install a sink in a countertop, the sink form may be placed on the countertop in the desired location and used as a template. A line is drawn around the form which defines the cut-out area. Using a saber saw or other suitable saw, the sink opening is cut out. A moisture barrier is then installed over the countertop and then a layer of metal lath. The sink form is then positioned in the sink opening and secured to the exposed edge of the countertop with screws through the above-mentioned slots. The slots provide a means for adjusting the depth of the concrete layer upon which the sink flange is supported and for providing a smooth and level surface for the sink flange. The float layer of concrete is then poured on the countertop and trowelled into position flush with the outside periphery of the sink form. When the concrete is dry, the sink form is removed and the sink placed in the sink opening with its flanges evenly supported on the concrete ledge provided. The quarter round tiles are then installed over the sink flange and the curved concrete surface provided to receive them. The flat countertop tiles are then laid on the concrete surface and grout is applied to the spaces between the tiles.

Optionally, the sink form of this invention may have a bottom which closes the form. The closed form provides further advantages:

a) it may be used when packed with a sink to protect the upper surface of the sink before installation;

b) when the sink form is installed prior to installation of the concrete or other base for the tile, the sink form prevents any concrete splatters from falling onto the cabinet shelving or interior of the cabinet; and c) the sink form may be easily and inexpensively produced by vacuum/thermo forming techniques which are well known in the plastics art.

BRIEF DESCRIPTION OF THE DRAWINGS

FIG. 2 is a fragmentary sectional view showing the sink form installed against a cut out edge of the sink opening;

FIG. 3 is a fragmentary sectional view like that of FIG. 2 with the concrete "float" layer in place and the sink and tile installed;

FIG. 4 shows plan views of some alternative shapes of sink form according to the invention.

DESCRIPTION OF THE PREFERRED EMBODIMENT

Figure 1:
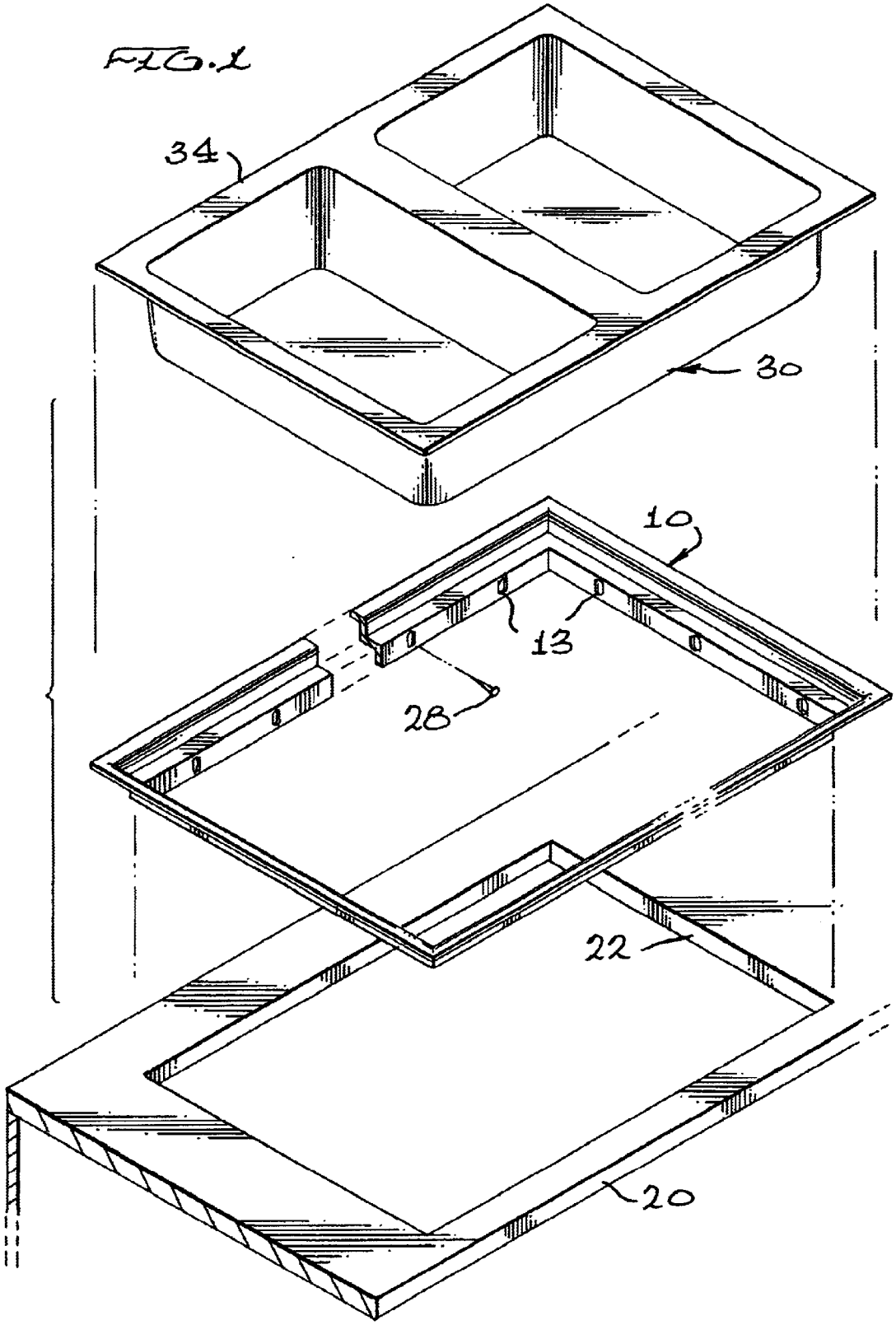
FIG. 1 is an exploded view showing a countertop cut out to receive a sink, a sink and a sink form according to the invention with a portion of the bottom of the sink form broken away for clarity.

FIG. 1 is an exploded view of a countertop 20 with a cut-out opening 22 for receiving a sink 30, and a sink form 10 according to the invention. The sink form 10, which is preferably of plastic, as described above, but which could be of metal fits into the cut-out opening 22 and is secured to its edge. As shown in FIG. 2, the cross section of sink form 10 includes a downwardly extending portion 12 with a screw-receiving slot 13, a laterally extending flange portion 14, and an upwardly extending portion 16 at the outer edge of flange portion 14, which terminates in an outwardly curved part 18. A number of slots 13 are spaced around the periphery of sink form 10 as shown in FIG. 1.

Sink form 10 may be used as a template to trace a cut-out opening 22 in the top of countertop 20, as described above. Following removing of the cut out, as shown in FIG. 1, a moisture barrier layer 24 and a metal lath layer 26 are installed (FIG. 2). Sink form 10 is then placed in cut-out opening 22 and secured by means of screws 28 in slots 13. It is desirable to initially attach the sink form 10 by means of a few screws placed at the back and front edges of the cut out. The height of flange portion 14 above the metal lath layer is then adjusted, as desired, by sliding sink form 10 up or down as permitted by slots 13, and then tightening screws 28. Then the remaining screws are installed. In this way, a substantially uniform spacing below flange portion 14 is provided to support the flanges of a sink to be installed and flange portion 14 can be made level all around the periphery of cut-out opening 22 so that the sink will be level.

The sink form 10 optionally includes a bottom 10*b*, as shown in FIG. 1, partly broken away. When the sink form 10 is produced with a bottom, it may be produced using readily available vacuum/thermo formable sheet plastic, such as polyethylene, polycarbonate, ABS, or polystyrene. The preferred material is ⅛" sheet polyethylene.

The sink form 10, with a bottom 10*b*, may be packed with a sink to protect it in shipment and all the time up until the sink form 10 is removed to be used in carrying out the method of this invention.

After the sink form 10 is used to outline the sink opening in the cabinet top 20. The sink opening is cut, and the sink form 10 is placed in the opening 22. The bottom 10*b* protects the interior of the cabinet from any spilled or overflow of concrete or thin set material into the interior of the cabinet. A messy cleanup task is thereby avoided. These different features of the invention demonstrate its broad utility despite its simple design. The sink form 10, of course, is reusable.

When the sink form 10 is secured as desired, the concrete "float" layer 29 is applied and trowelled right up to the outer side of form 10 of FIGS. 1 and 2 to produce the concrete layer as shown as in FIG. 3. This establishes the thickness of the sink-supporting ledge 15 and the curvature of the concrete layer on the outside of curved portion 18 to mate with the inside curve of the quarter round tiles 32 of FIG. 3. The backsplash may also receive a concrete layer at this time.

When the concrete is dry, sink form 10 is removed by removing screws 28 and lifting sink form 10 out of cut-out opening 22. A sink 30 is then placed in cut-out opening 22, with its laterally extending mounting flange 34 over ledge 15 as shown in FIG. 3, and the quarter round tiles 32 are installed over the sink flange 34 and over the curved concrete edge with a suitable adhesive or grout 35. The remainder of the flat tiles 36 are then laid on float layer 29 and grout is applied to the spaces between the tiles as shown at numeral 38.

Figure 5:
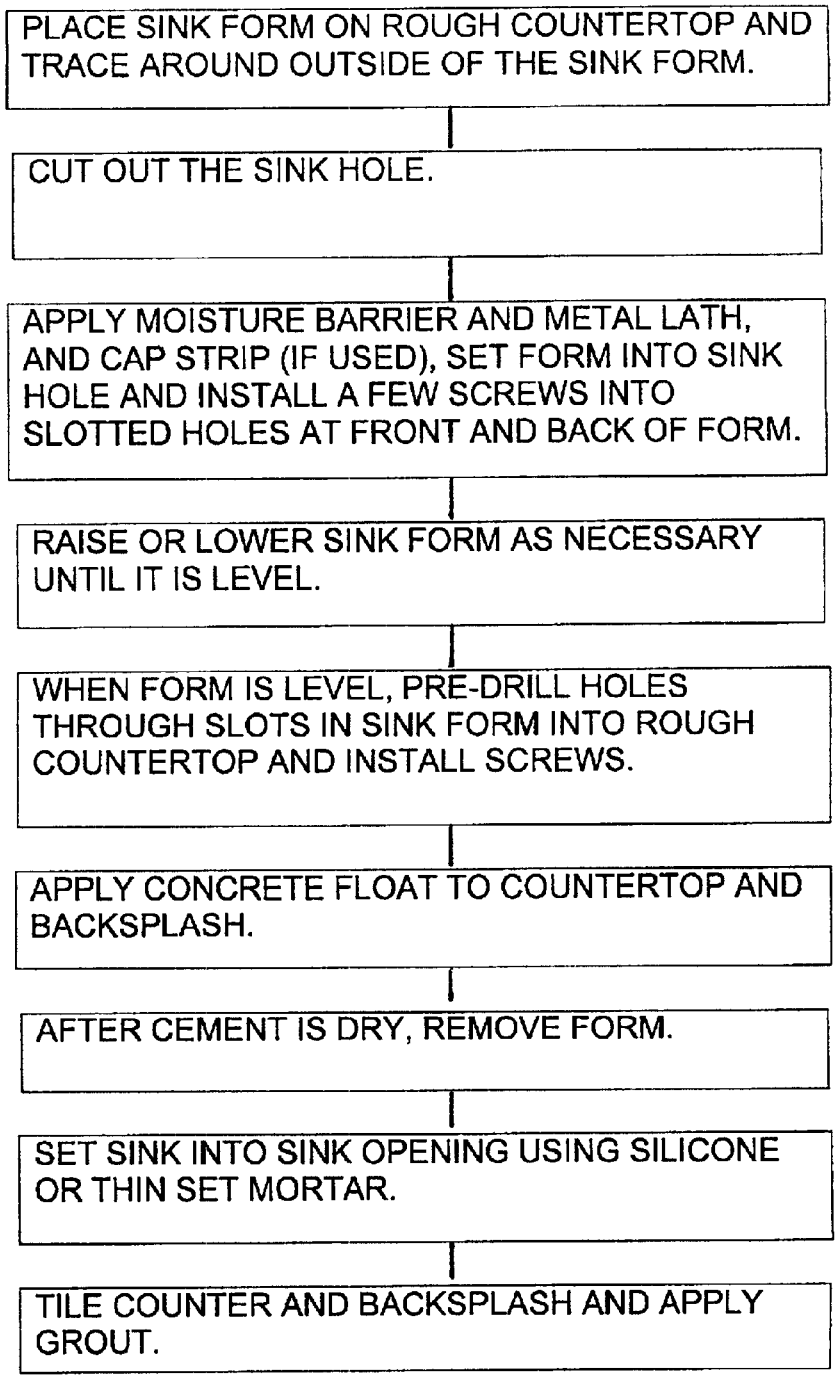
FIG. 5 is a flow diagram of the process of installing a sink in a countertop which is to be finished with ceramic tile.

FIG. 5 is a block diagram or flow diagram showing the steps described above which are employed in using applicant's novel sink form in the course of installing a sink in a countertop which is to be covered with ceramic tile.

While the above installation has been described in relation to a typical rectangular kitchen sink installed with a ceramic tile countertop, the sink form of the invention may be made in other forms as shown in FIG. 4 to fit the several sink sizes and shapes available. Round or octagonal sinks 10' or 10" are frequently used in bathrooms, as are oval sinks. Longer rectangular sinks are available, including those having three separate sink sections. Small rectangular sinks are frequently installed in wet bars, but the cross-sections of the sink forms used are the same as shown in FIGS. 1 and 2. To fit properly in corners, each size and shape of sink preferably requires a corresponding shape of sink form. An elongated, flexible, plastic strip of the described cross section cut to the length of the perimeter of the cut-out opening can be used for round or oval-shaped sinks.

Except for the elongated, flexible, plastic strips, which can be used for installing round or oval sinks, the sink forms may be comparatively stiff or rigid and could be made of relatively inflexible plastic or even of metal. The forms also may be of varying weights with lightweight plastic forms, for example, being supplied with the sink for one time use or heavier forms suitable for use in installing a number of sinks.

The above-described embodiments of the present invention are merely descriptive of its principles and are not to be considered limiting. The scope of the present invention instead shall be determined from the scope of the following claims including their equivalents.

I claim:

1. A sink form for use in installing a sink having laterally extending flanges in a countertop having a cut-out opening for receiving said sink, said sink form having a cross section including a downwardly extending portion, a laterally extending flange portion and an upwardly extending portion at the outer edge of said flange portion terminating in an outwardly extending curved part.

2. A sink form as claimed in claim 1 wherein quarter round tiles having curved inside surfaces are to be installed over said flanges and the curvature of said outwardly extending curved part substantially matches said inside curved surfaces.

3. A sink form as claimed in claim 1 wherein a plurality of spaced vertically oriented slots are formed in said downwardly extending portion.

4. A sink form in accordance with claim 1 wherein said sink form includes a bottom which encloses the space therein of said downwardly extending portion.

5. A sink form for use in installing a sink having laterally extending flanges in a countertop having a cut-out opening for receiving said sink, said sink form having a cross section including a downwardly extending portion having a plurality of spaced slots for receiving screws to fasten said sink form to the edge of said cut-out opening, a laterally extending flange portion having a width approximately equal to or slightly less than the width of the flanges of the sink to be installed and an upwardly extending portion at the outer edge of said flange portion terminating in an outwardly extending curved part.

6. A sink form as claimed in claim 5 wherein quarter round tiles having curved inside surfaces are to be installed over said flanges and the curvature of said outwardly extending curved part substantially matches said curved inside surfaces.

7. A sink form as claimed in claim 5 wherein the overall shape of said sink form is rectangular.

8. A sink form as claimed in claim 5 wherein the overall shape of said sink form is hexagonal.

9. A sink form as claimed in claim 5 wherein said sink form is an elongated strip of flexible material cut to the length of the perimeter of said cut-out opening for installing a round or oval sink.

10. A sink form as claimed in claim 5 wherein said sink form is of a flexible plastic material.

11. A sink form as claimed in claim 5 wherein said sink form is of stiff or rigid material sized to fit within said cut-out opening.

12. A sink form as claimed in claim 5 wherein said sink form is a single sheet of formed plastic including a bottom closing the downward extending portion.

13. For use in installing a sink having laterally extending flanges in a countertop in which an opening has been cut out for receiving said sink and wherein quarter round tiles are to be installed over said flanges;

a sink form of proper dimensions to fit said cut-out opening having a cross section including a downwardly extending portion fitting against the edge of said cut-out opening, a laterally extending flange portion whose width is approximately equal to or slightly less than the width of the flanges of the sink to be installed and an upwardly extending portion at the outer edge of the flange portion terminating in an outwardly extending curved part whose curvature essentially matches the inside curvature of said quarter round tiles.

14. A sink form as claimed in claim 13 wherein a plurality of spaced slots are formed in said downwardly extending portion.

15. A sink form as claimed in claim 13 wherein said sink form is a single sheet of formed plastic including a bottom closing the downward extending portion.

16. A method of installing a sink having laterally extending flanges in a countertop having an opening for receiving said sink including the steps of:

1) installing a moisture barrier layer over said countertop;

2) installing a metal lath layer over said countertop;

3) installing a sink form in said opening, said sink form having a cross section including a downwardly extending portion which is secured to the edges of said opening and a laterally extending flange portion, said downwardly extending portion being vertically spaced to allow for a layer of concrete float material between said moisture barrier layer and said laterally extending portion and an upwardly extending portion terminating in an outwardly curved part;

4) applying a concrete float layer over said moisture barrier layer and between said moisture barrier and said flange portion and permitting said layer to dry;

5) removing said sink form; and 6) installing said sink in said opening.

17. A method of installing a sink including steps 1) through 6) of claim 16 and including the further steps of:

7) installing quarter round tiles over the laterally extending flanges of said sink;

8) laying tile over said concrete float layer; and 9) applying grout to the spaces between said tiles.

18. A method installing a sink having laterally extending flanges in a countertop having an opening for receiving said sink, said countertop being prepared to receive a concrete float layer comprising the steps of:

1) installing a sink form in said opening, said sink form having a downwardly extending portion secured to the edges of said opening and a laterally extending flange portion, said downwardly extending portion being vertically positioned to space said flange portion away from the surface of said countertop, and an upwardly extending portion terminating in an outwardly curved part;

2) applying a concrete float layer over said countertop and extending between said flange portion and said countertop and allowing said float layer to dry;

3) removing said sink form; and 4) installing said sink in said opening.

19. A method of installing a sink including steps 1) through 4) of claim 18 and including the further steps of:

5) installing quarter round tiles over the laterally extending flanges of said sink;

6) laying tile over said countertop; and 7) applying grout to the spaces between said tiles.

20. A method of installing a sink as claimed in claim 18 wherein said downwardly extending portion includes a plurality of spaced vertically oriented slots, said downwardly extending portion is secured to the edges of said opening by means of screws passing through said slots and said flange portion is spaced above said countertop by moving said downwardly extending portion relative to said screws as desired and then tightening said screws.

* * * * *